US005233360A

United States Patent [19]

Kuroda et al.

[11] Patent Number: 5,233,360

[45] Date of Patent: Aug. 3, 1993

[54] MATCHING DEVICE FOR A MICROSTRIP ANTENNA

[75] Inventors: Shinichi Kuroda, Saitama; Ichiro Toriyama, Kanagawa; Noboru Ono, Tokyo; Koji Maruyama, Kanagawa, all of Japan

[73] Assignee: Sony Corporation, Tokyo, Japan

[21] Appl. No.: 736,281

[22] Filed: Jul. 25, 1991

[30] Foreign Application Priority Data

Jul. 30, 1990 [JP] Japan ..... 2-202054
Jul. 31, 1990 [JP] Japan ..... 2-203469

[51] Int. Cl.[5] ..... H01Q 13/08; H01P 5/08

[52] U.S. Cl. ..... 343/700 MS; 343/860; 343/862; 333/33

[58] Field of Search ..... 343/700 MS, 846, 850, 343/852, 860, 861, 862, 863, 864; 333/33, 34

[56] References Cited

U.S. PATENT DOCUMENTS

| | | | |
|---|---|---|---|
| 2,411,555 | 10/1942 | Rogers | 343/700 MS |
| 3,508,269 | 4/1970 | Snyder | 343/864 |
| 3,757,342 | 9/1973 | Jasik et al. | 343/700 MS |
| 4,445,122 | 4/1984 | Pues | 343/700 MS |
| 4,475,107 | 10/1984 | Makimoto et al. | 343/700 MS |
| 4,766,440 | 8/1988 | Gegan | 343/700 MS |
| 5,121,127 | 6/1992 | Toriyama | 343/700 MS |

FOREIGN PATENT DOCUMENTS

| | | | |
|---|---|---|---|
| 0279704 | 12/1987 | Japan | 343/700 MS |
| 2142475 | 1/1985 | United Kingdom | 343/700 MS |

OTHER PUBLICATIONS

Patent Abstracts of Japan, vol. 12, No. 168 (E-611) May 1988.

IEEE Transactions on Antennas and Propagation, vol. 23, No. 1, Jan. 1975, (pp. 90-93).

*Primary Examiner*—Michael C. Wimer
*Assistant Examiner*—Tan Ho
*Attorney, Agent, or Firm*—Lewis H. Eslinger; Jay H. Maioli

[57] ABSTRACT

A matching device for an antenna in which is interposed between an antenna of narrow frequency band and a feeding line so as to match the antenna and the feeding line over a wide band, includes a high impedance line of a first predetermined length provided at the antenna side and a low impedance line of a second predetermined length provided at the feeding line side that are connected in series, whereby the matching device can be made small in size and simple in construction.

3 Claims, 11 Drawing Sheets

MATCHING DEVICE FOR A MICROSTRIP ANTENNA

BACKGROUND OF THE INVENTION

1. Field of the Invention

The present invention relates to a matching device suitable for use with a microstrip antenna.

2. Description of the Prior Art

A conventional microstrip antenna 10 is represented in FIG. 1 and this microstrip antenna 10 has a radiation element 13 provided on a dielectric layer 12 formed on a ground conductor 11. The microstrip antenna 10 is used for radio communications in airplanes, automobiles and so on where particularly UHF/SHF bands are used because the microstrip antenna 10 can provide a desired unidirectivity under with its simple structure and low-height installation.

However, since the microstrip antenna 10 has a high Q and a narrow frequency band width, it cannot be used in radio communications using two frequencies for transmission and reception, respectively.

To obviate the above shortcoming, it is proposed to mount a parasitic antenna element in front of the radiation element for widening the frequency band by the resulting double-resonant state. This proposal, however, has a problem that the height of the entire antenna is unavoidably increased because the parasitic antenna element is mounted in front of the radiation element.

Whereas, Japanese Laid-Open Patent Publication No. 62-279704 describes a technique such that a matching device including a stub is interposed between the antenna and the feed line as shown in FIG. 1.

As shown in FIG. 1, a matching device 20 has conductor lines 23 to 25 connected in series on a grounded conductor 21 with a dielectric layer 22 therebetween, and has a stub 26 of an L-letter configuration branched from a mid point $P_M$, and connectors 27, 28 provided on the load and input sides so as to be connected to the conductor lines 23 to 25, respectively. A feed point 14 of the antenna 10 is connected to one connector 27 of the matching device 20 by way of a coaxial feed line 15 and a connector 16. The other connector 28 of the matching device 20 is connected with a feed line (not shown).

A length l1 between the feed point 14 and the mid point $P_M$ is selected so that, at two different frequencies f1, f2 ($f1<f2$), the conductance components as viewed from the mid point $P_M$ of the matching device 20 toward the antenna 10-side are equal, but the susceptance components B1, B2 ($|B1|>|B2|$) are opposite in sign.

Further, a length l2 and the characteristic impedance of the stub 26 are selected such that the susceptance components of the stub 26 as viewing from the mid point $P_M$ takes values $-B1$, $-B2$ at the frequencies f1, f2, respectively.

Accordingly, at the two desired frequencies f1, f2, the resultant admittances as viewed from the mid point $P_M$ toward both the stub 26 and the antenna 10 are equal to each other.

The intermediate conductor line 24 is a known quarter-wave-line transformer, which converts the resultant admittance as viewing from the mid point $P_M$ into a standard value [1] as viewed from the input side connector 28.

Thus, by the use of the matching device 20, it is possible to match the impedance values of the antenna 10 at the two desired frequencies f1, f2, the frequency band being thereby widened.

The above matching device 20 can be unitarily formed with the antenna 10 by making two grounded conductors thereof common as shown in FIG. 2. In FIG. 2, reference numeral 17 designates a connecting conductor, and 29 a non-grounded conductor. The non-grounded conductor 29 represents the feed line 15, the conductor lines 23 to 25 and the stub 26 shown in FIG. 1.

However, since the above matching device 20 has the stub 26 branched from the conductor line 23, the size of the matching device 20 is relatively large even though the stub 26 is of an L-letter shape.

In addition, if the matching device 20 is formed of coaxial conductors, then the matching device 20 becomes complicated in structure.

OBJECTS AND SUMMARY OF THE INVENTION

Accordingly, it is an object of the present invention to provide an improved matching device for use with an antenna in which the aforementioned shortcomings and disadvantages encountered with the prior art can be eliminated.

More specifically, it is an object of the present invention to provide a matching device for use with an antenna which is small and simple.

Another object of the present invention is to provide a small and simple matching device for use with an antenna in which an antenna of narrow band can be matched with a feed line in a wide band.

As a first aspect of the present invention, there is provided a matching device for use with an antenna in which the matching device is interposed between an antenna of narrow frequency band and a feeding line so as to match the antenna and the feeding line over a wide band, in which a high impedance line of a first predetermined length is provided at the antenna side, and a low impedance line of a second predetermined length is provided at a feeding line side, wherein the high impedance line and the low impedance line are connected in series.

In accordance with a second aspect of the present invention, a matching device for antenna in which the matching device is interposed between an antenna of narrow frequency band and a feeding line so as to match the antenna and the feeding line over a wide band is comprised of a standard impedance line of a first predetermined length provided on the antenna side, a first low impedance line of a second predetermined length, a high impedance line of a third predetermined length, the low impedance line of the second predetermined length and the high impedance line of the third predetermined length being in turn connected in series to the standard impedance line, and a second low impedance line of the second predetermined length connected in series to the high impedance line at its feeding line side.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

The present invention will now be described with reference to the drawings.

Figure 1:
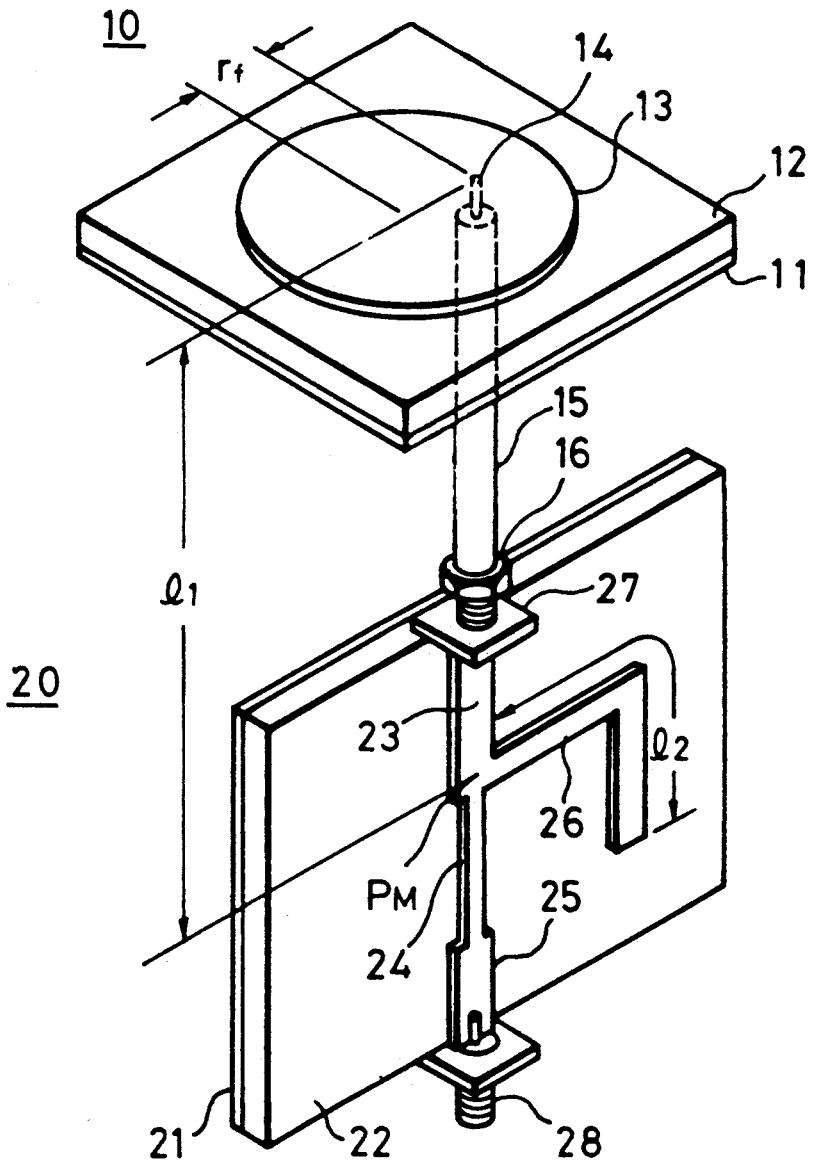
FIG. 1 (PRIOR ART)
FIG. 1 is a perspective view of an example of an arrangement of a matching device for use with an antenna according to the prior art.
Figure 3:
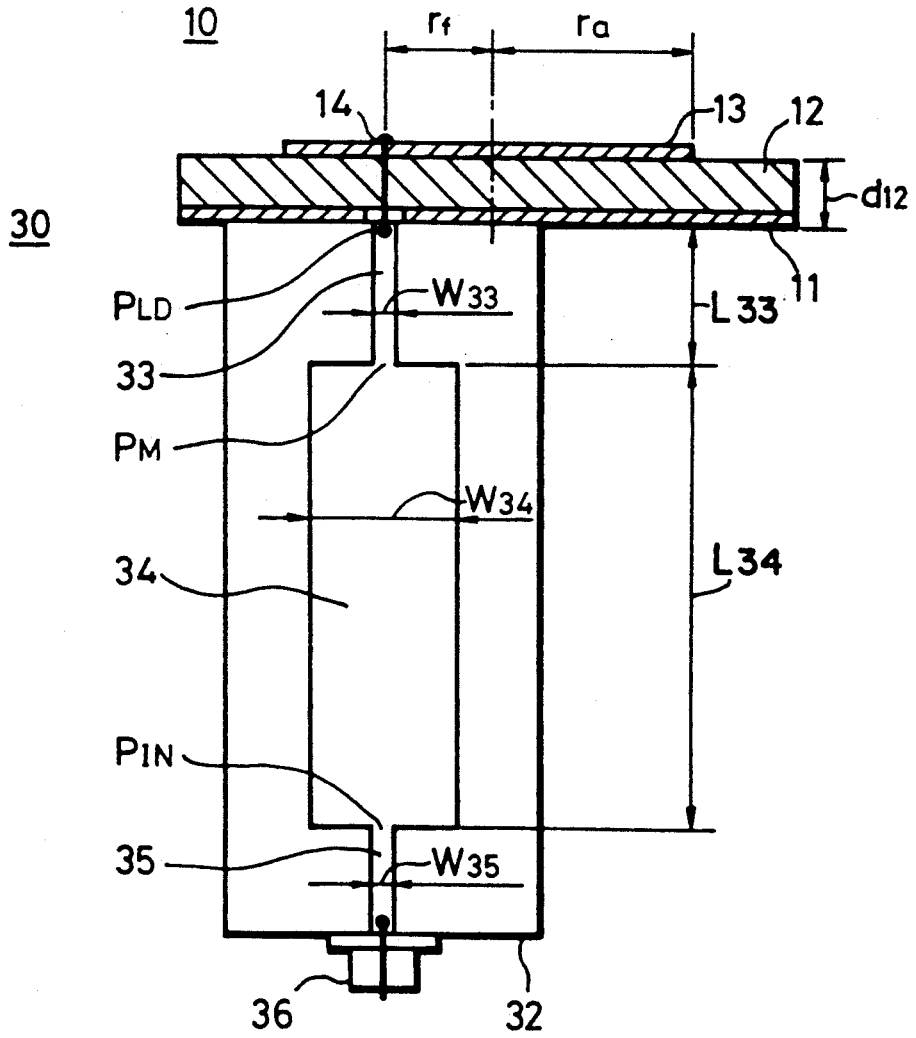
FIG. 3 is an expanded view of an arrangement of an embodiment of the matching device for use with an antenna according to the present invention.

FIG. 3 shows an expanded view of the first embodiment of the matching device for a microstrip antenna according to the present invention. In FIG. 3, like parts corresponding to those of FIG. 1 are marked with the same references and therefore need not be described in detail.

As shown in FIG. 3, the radiation element 13 of the microstrip antenna 10 has the feeding point 14 shifted by a predetermined distance rf from its center and this radiation element 13 is excited in the TM (transverse magnetic mode) 21 mode.

For example, at the frequency band of 2.5 GHz, the radius ra of the radiation element 13 and the offset distance rf of the feeding point 14 are selected as $$ra = 35.5 \text{ mm} \quad rf = 17.5 \text{ mm}$$

when the thickness d12 and relative dielectric constant $\epsilon_r$ of the dielectric layer 12 are given as $$d12 = 3.2 \text{ mm} \quad \epsilon_r = 2.6$$

A matching device 30 has three conductor lines 33, 34 and 35 formed and connected in series on a low-loss dielectric layer 32 of, for example, fluoroplastics such as polytetrafluoroethylene (PTFE), formed on the grounded conductor (not shown), thus to form a microstrip line structure.

Figure 2:
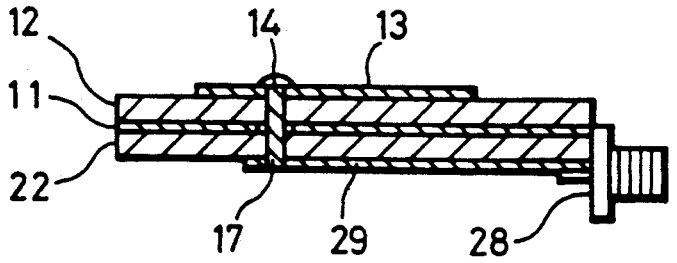
FIG. 2 (PRIOR ART)
FIG. 2 is a top view of another example of an arrangement of a matching device for use with an antenna according to the prior art.

Also in this embodiment, as previously shown in FIG. 2, the matching device 30 and the antenna 10 can be formed as one body by utilizing the common grounded conductor.

Widths W33, W35 of the conductor lines 33, 35 at both ends of the matching device 30 are reduced so that their characteristic impedances become equal to the standard value 50 ohms. A width W34 of the conductor line 34 formed at the intermediate portion of the matching device 30 is selected to be wide enough so that its characteristic impedance is considerably lowered to be, for example, several ohms.

A length L33 of the narrow conductor line 33 is selected to be slightly shorter than $\lambda/4$ and a length L34 of the wide conductor 34 is selected substantially to be $1\lambda$.

The narrow conductor line 33 is connected to the feeding point 14 of the antenna 10 and the other conductor line 35 is connected to a connector 36. This connector 36 is connected with a feed line (not shown) having a characteristic impedance of 50 ohms.

Figure 4:
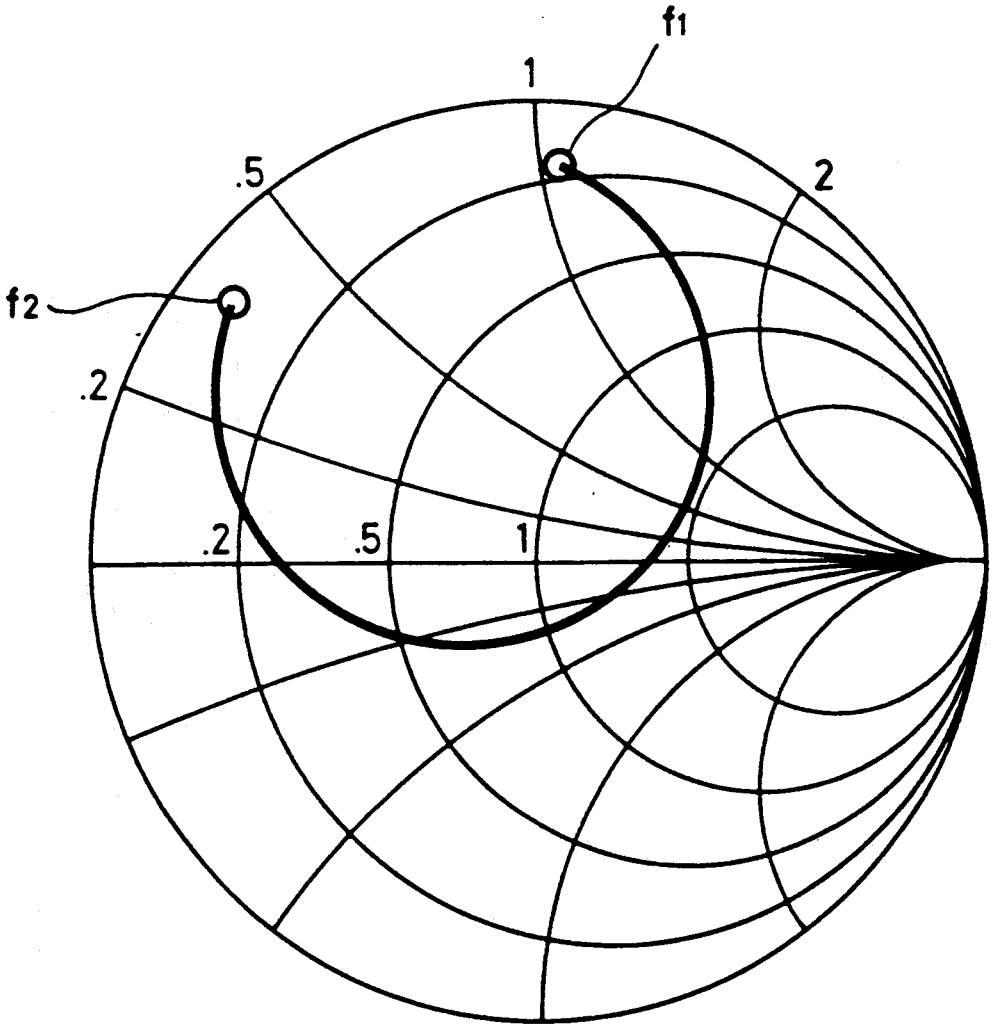
FIGS. 4 to 6 are Smith charts used to explain the first embodiment of the present invention.
Figure 7:
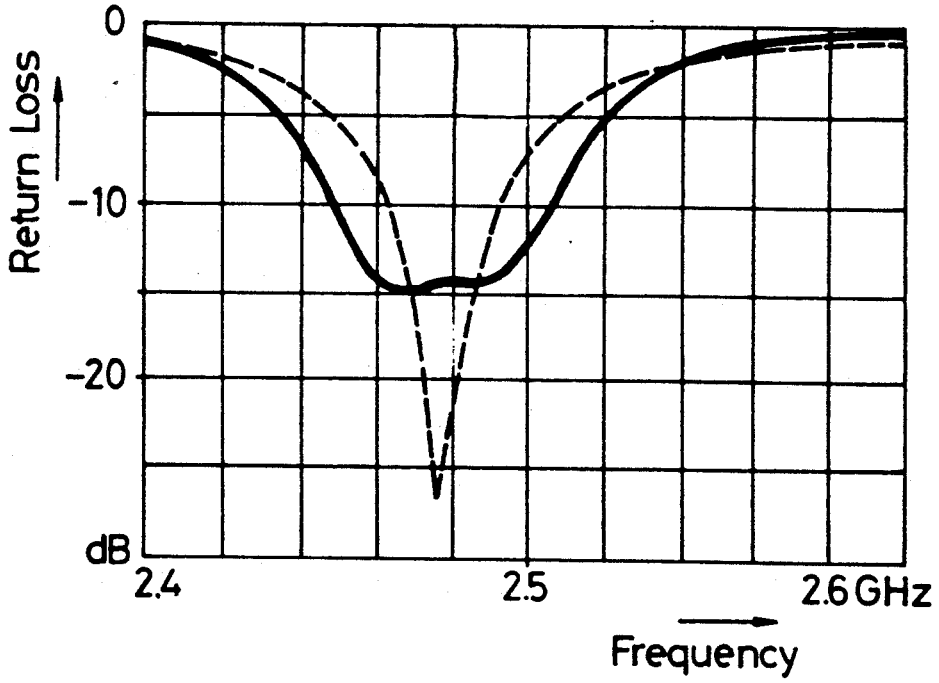
FIG. 7 is a graph of frequency vs. return loss characteristic used to explain the first embodiment.

In this embodiment, as will be easily understood from experimental results such that a reflection loss (return loss) presents a characteristic of sharp V-letter configuration as shown by a broken line in FIG. 7, the frequency band width of the antenna 10 itself is extremely narrow and the load impedance ZLD as viewed from one end PLD of the conductor line 33 toward the antenna 10 can be found on the Smith chart as shown in FIG. 4.

Figure 5:
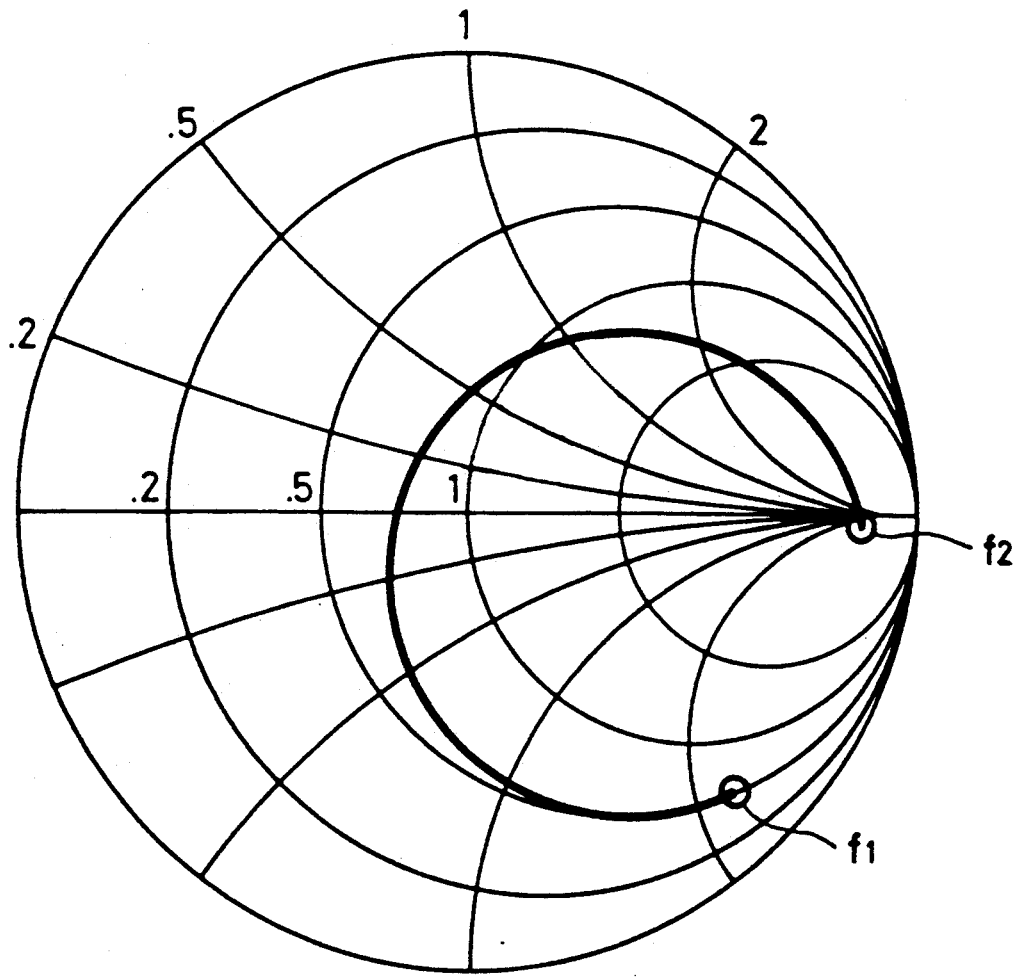

This load impedance ZLD is rotated on the Smith chart by a line having a characteristic impedance of 50 ohms and a length slightly smaller than $\lambda/4$ (corresponding to the conductor line 33) so that the intermediate impedance ZM as viewed from the connection point PM between the wide conductor line 34 and the conductor line 33 is as shown in FIG. 5.

Figure 6:
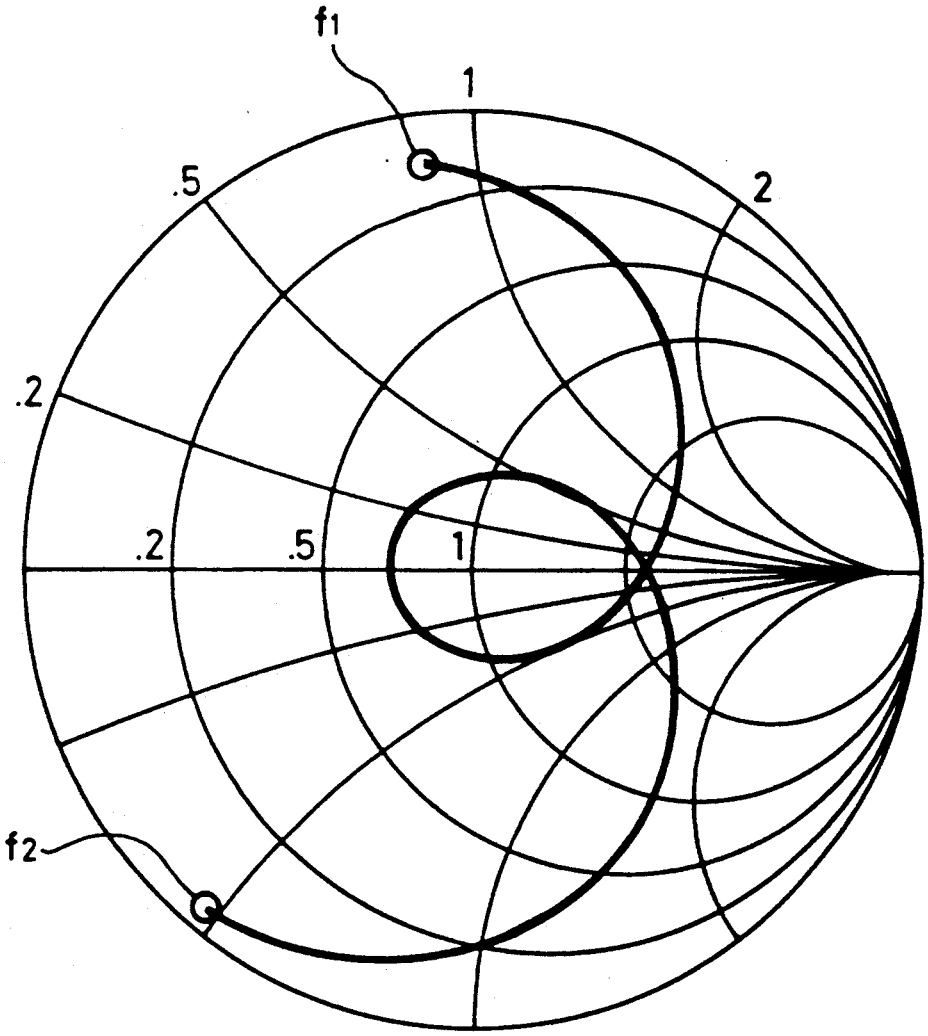

This intermediate impedance ZM is equivalently added with an impedance that is substantially conjugate therewith in a desired frequency region by a line having a characteristic impedance of several ohms and a length of about $1\lambda$ (corresponding to the conductor line 34). As a consequence, the input impedance ZIN as viewed from the other end PIN of the wide conductor line 34 toward the antenna side is almost concentrated around the center on the Smith chart as shown in FIG. 6.

Consequently, the total return loss at the other end PIN of the conductor line 34 exhibits a U-letter curve as shown by a solid line in FIG. 7. From FIG. 7, it will be seen that the microstrip antenna 10 and the feed line are matched over a relatively wide frequency range of about 50 MHz.

As described above, according to this embodiment, the matching device can be miniaturized by such a simple arrangement that the wide and narrow conductor lines having predetermined lengths are connected in series.

While in the above embodiment the matching device 30 is of the open-type microstrip line as described above, if the matching device 30 may be formed as a shield-type in which a dielectric layer and a grounded conductor are formed on both sides of the line conductor, that is, a so-called triplet type, then the width of the conductor line is reduced substantially by half and the length thereof is reduced substantially to $$1/\sqrt{\epsilon_r},$$

thus the matching device being further small-sized.

If the matching device 30 is of the triplet type, the widths and lengths of the two conductor lines 33, 34 are selected as $$W33 = 1.1 \text{ mm} \quad W34 = 12 \text{ mm}$$
$$L33 = 15 \text{ mm} \quad L34 = 75 \text{ mm}$$

in the frequency band of, for example, 2.5 GHz when the thickness of the dielectric layer and the relative dielectric constant thereof are given as $$d = 1.6 \text{ mm} \quad \epsilon_r = 2.6$$

As set out above in detail, according to the above embodiment of this invention, since a high impedance conductor line having a first predetermined length provided at the antenna side is connected in series to a low impedance conductor line having a second predetermined length provided at the feeding line side, the matching device for the microstrip antenna can be produced, which is small and simple and which can match a narrow-band antenna with a feed line over a wide frequency range.

Figure 8:
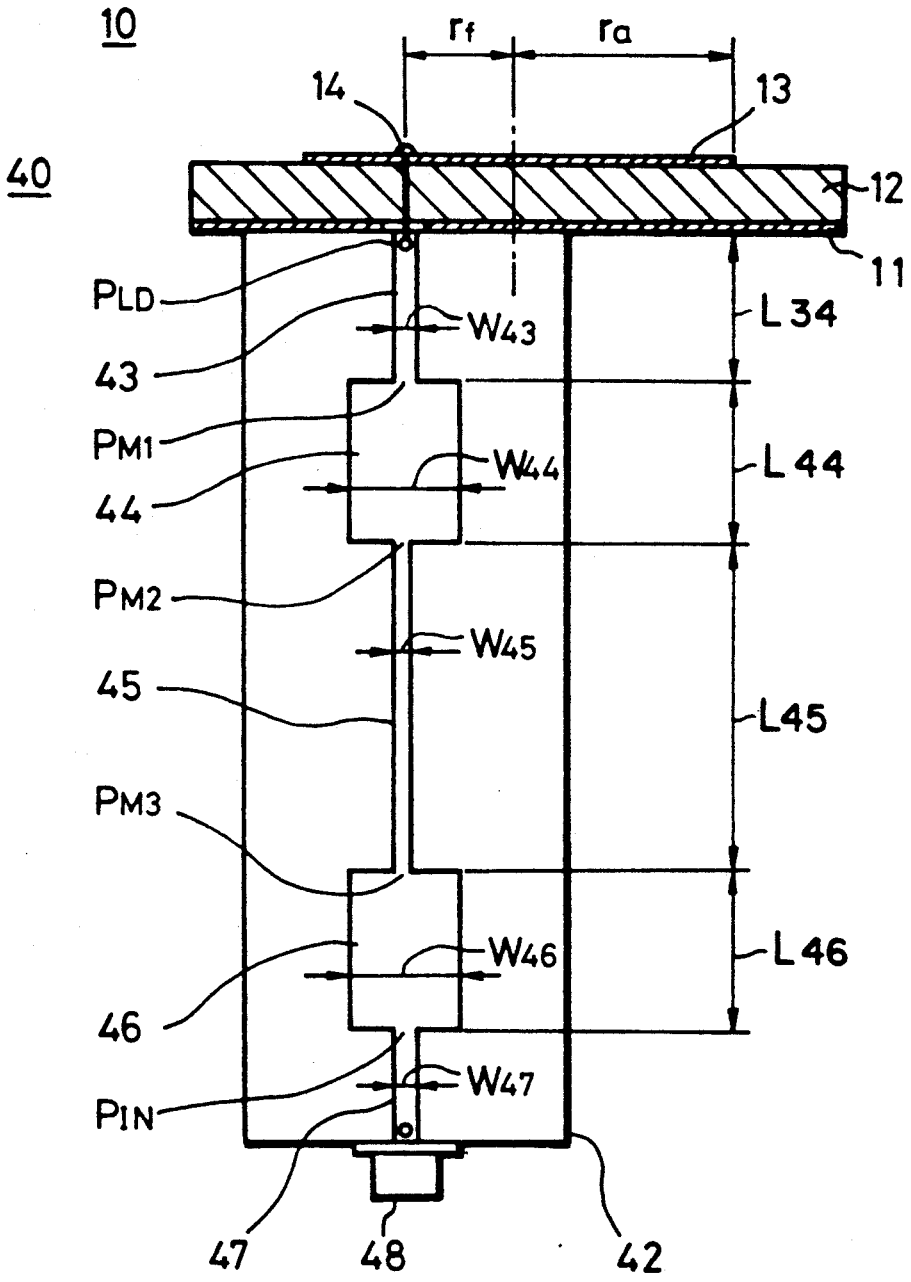
FIG. 8 is an expanded view of an arrangement of a second embodiment of the matching device for an antenna according to the present invention.

FIG. 8 shows an arrangement of a second embodiment of the matching device for a microstrip antenna according to the present invention. In FIG. 8, the arrangement of the microstrip antenna 10 is the same as that of FIG. 3 and therefore need not be described.

Referring to FIG. 8, a matching device 40 is of a microstrip line type such that five conductor lines 43, 44, 45, 46 and 47 are formed on a grounded conductor (not shown) in series via a dielectric layer 42 of low loss made of, for example, a fluoroplastics, such as polytetrafluoroethylene (PTFE).

Similar to FIG. 2, in this embodiment the matching device 40 and the antenna 10 can be formed as one body by using the common grounded conductor therefor.

Widths W43 and W47 of the conductor lines 43, 47 at respective end portions are set such that the characteristic impedances thereof become a reference value, 50 ohms. Widths W44 and W46 of conductor lines 44, 46 of the intermediate portions adjacent to the conductor lines 43, 47 are selected wide such that characteristic impedances thereof become considerably lower than the reference value of 50 ohms.

A width W45 of the center line conductor 45 is selected narrow so that its characteristic impedance is considerably higher than 50 ohms.

Further, the length L43 of the conductor line 43 at the end is selected to be slightly smaller than $\lambda/4$, both the lengths L44, L46 of the wide conductor lines 44, 46 are selected to be about $\lambda/4$, and the length L45 of the center conductor line 45 is selected to be about $\lambda/2$.

The conductor line 43 at one end is connected to the feeding point 14 of the antenna 10 and the conductor line 47 at the other end is connected to a connector 48. This connector 48 is connected with a feeding line (not shown) having a characteristic impedance of 50 ohms.

Figure 12:
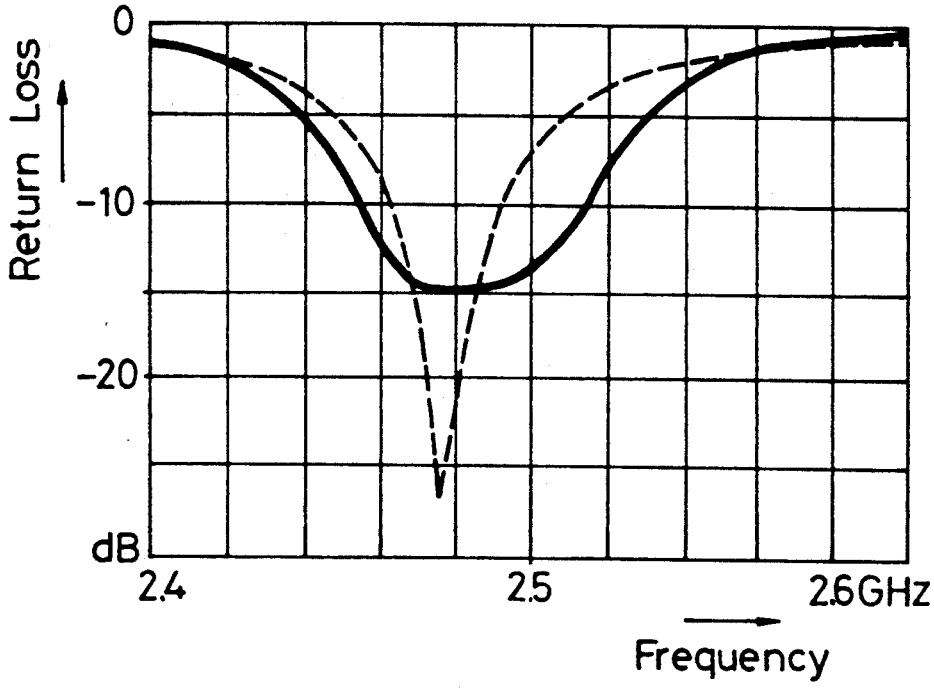
FIG. 12 is a graph of frequency vs. return loss characteristics used to explain the second embodiment.

In this embodiment, as will be easily understood from the experimental results such that the reflection loss (return loss) exhibits a sharp V-letter shape shown by a broken line in FIG. 12, the frequency band width of the antenna 10 itself is extremely narrow and the load impedance ZLD as viewed from one end PLD of the conductor line 43 toward the antenna can be found on the Smith chart in FIG. 4.

Figure 9:
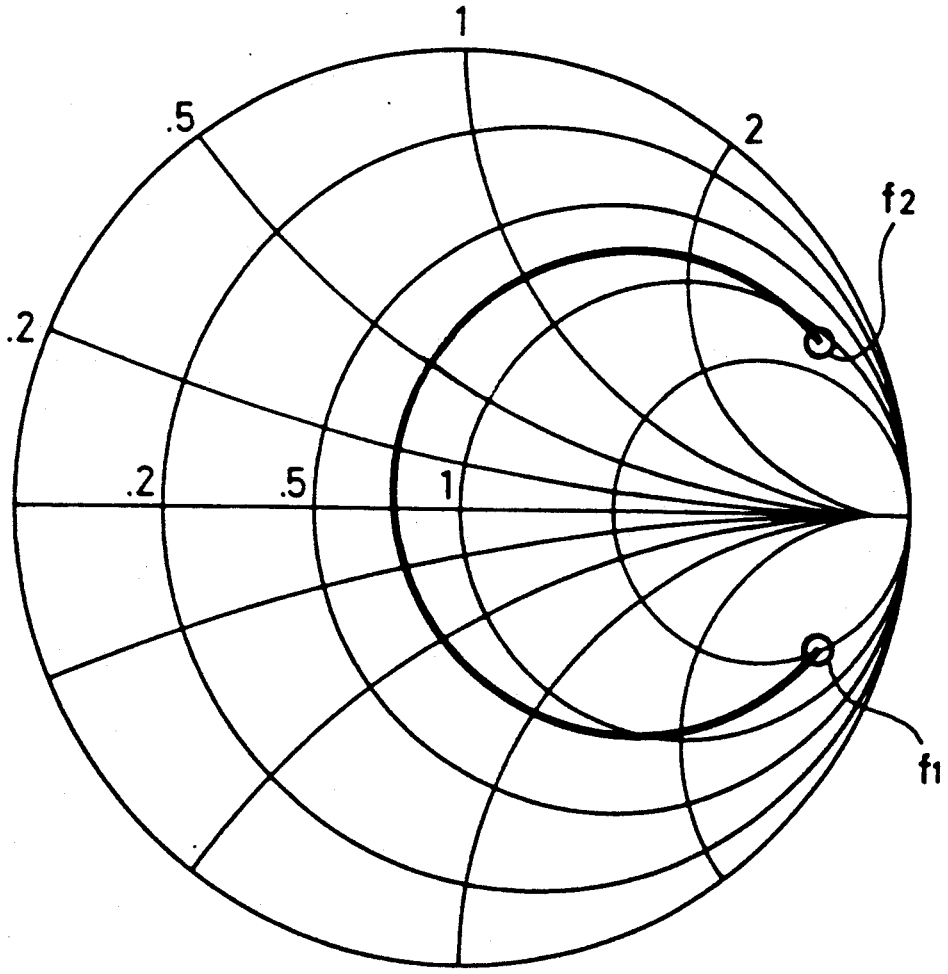
FIGS. 9 to 11 are Smith charts used to explain the second embodiment of the present invention.

This load impedance ZLD is rotated on the Smith chart by a line having a characteristic impedance of 50 ohms and a length of slightly smaller than $\lambda/4$ (which corresponds to the conductor 43), so that the intermediate impedance ZM1 as viewed from the connection point PM1 of the wide conductor line 44 and the conductor line 43 is symmetrical with respect to the real axis at the two predetermined frequencies f1, f2, as shown in FIG. 9.

Figure 10:
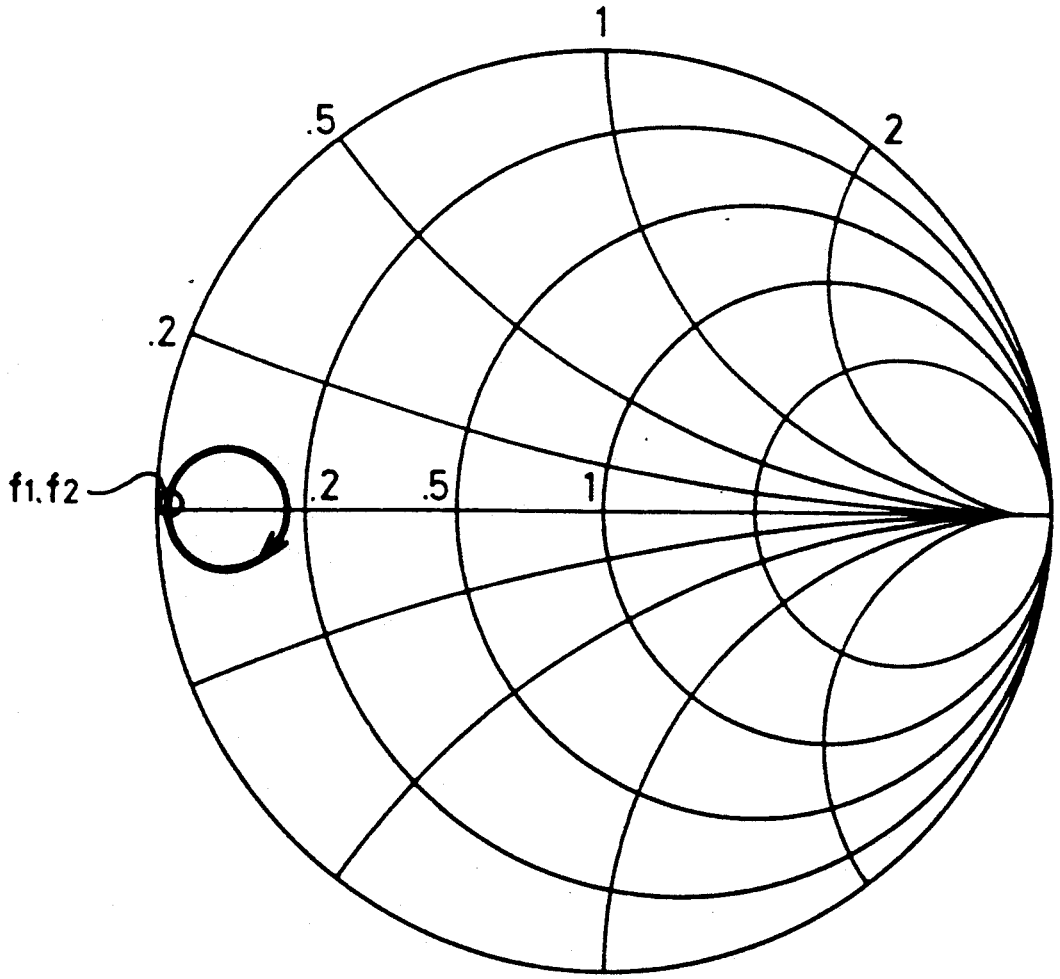

Further, the line having a low characteristic impedance and a length of about $\lambda/4$ (which corresponds to the conductor 44), converts this intermediate impedance ZM1, so that the second intermediate impedance ZM2 as viewed from the connection point PM2 between it and the center conductor line 45 toward the antenna side exhibits a small circle which intersects with the real axis at the two predetermined frequencies f1, f2 as shown in FIG. 10.

Figure 11:
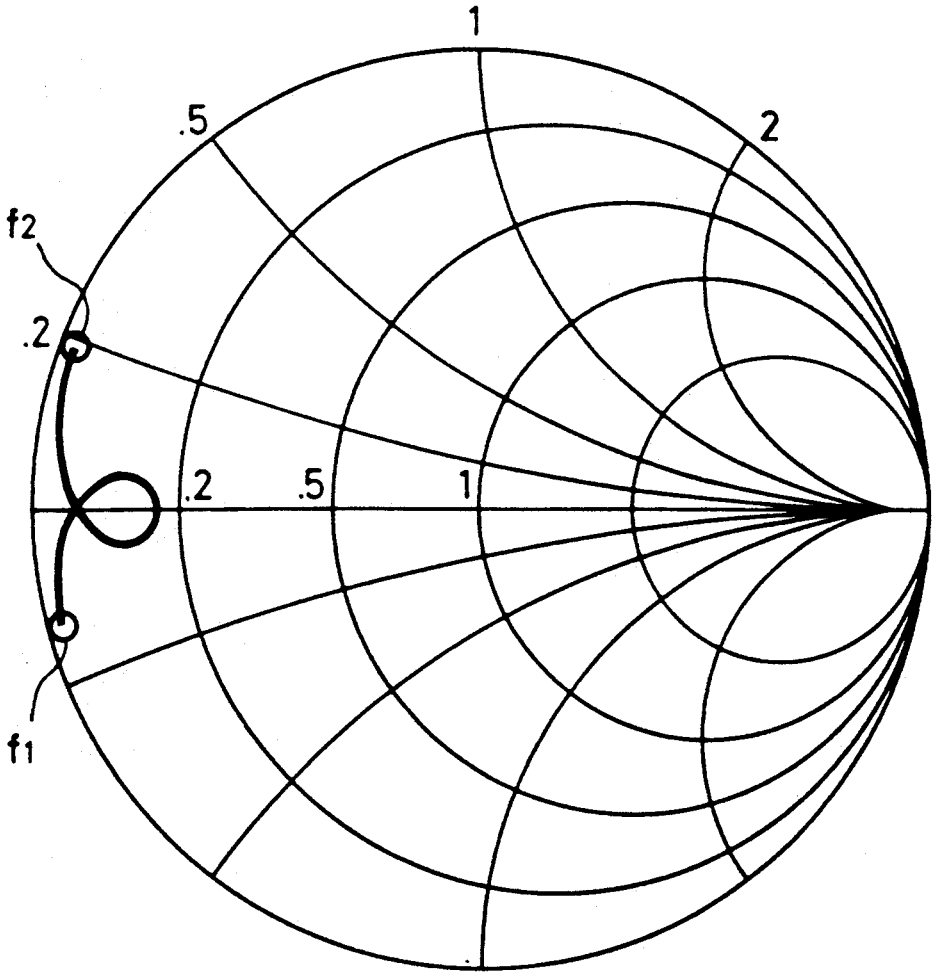

This intermediate impedance ZM2 is converted by the line having a high characteristic impedance and a length of about $\lambda/2$ (which corresponds to the conductor 45), so that the third intermediate impedance ZM3 as viewed from the connection point PM3 between it and the second wide conductor line 46 toward the antenna side exhibits a small loop which is separated from the real axis at the two predetermined frequencies f1, f2, as shown in FIG. 11.

Furthermore, this intermediate impedance ZM3 is converted by the line having a low characteristic impedance and a length of about $\lambda/4$ (which corresponds to the conductor 46).

The intermediate impedance ZM1 is equivalently added with an impedance that is substantially conjugate therewith in a desired frequency range by three lines 44 to 46 connected in series. As a consequence, the input impedance ZIN as viewed from the other end PIN of the wide conductor line 46 toward the antenna side is almost concentrated at around the center on the Smith chart, as shown in FIG. 6.

Thus, the total return loss at the other end PIN of the conductor line 46 exhibits a U-letter curve as shown by a solid line in FIG. 12. From FIG. 12, it will be seen that the microstrip antenna 10 is matched with the feeding line over a relatively wide frequency range of about 50 MHz.

As described above, the matching device of this embodiment can be miniaturized by such a simple arrangement that the wide and narrow conductor lines having predetermined lengths are connected in series.

While in the second embodiment the matching device 40 is of the open-type microstrip line as described above, it may be of the shield type in which a dielectric layer and a ground layer are formed on both sides of the line conductor, forming the so-called triplet type. In this case, the width of the line conductor is substantially halved and the length thereof is reduced to about $$1/\sqrt{\epsilon_r},$$

thus the matching device of this embodiment being further reduced in size.

In the triplet-type matching device 40, the widths and lengths of the respective line conductors 43 to 46 are selected as, for example, $$W43 = 1.1 \text{ mm} \quad W45 = 0.7 \text{ mm} \quad W44 = W46 = 4.5 \text{ mm}$$
$$L43 = 12 \text{ mm} \quad L45 = 37.5 \text{ mm} \quad L44 = L46 = 19 \text{ mm}$$

at the frequency band of 2.5 GHz when the thickness and the dielectric constant of the dielectric layer are given as $d = 1.6$ mm $\epsilon_r = 2.6$ While this embodiment is the application of this invention to a microstrip line, this invention may be applied to a coaxial conductor line, in which case, its structure is extremely simple.

As described above, according to the second embodiment of the present invention, since the standard impedance line having the first predetermined length and provided on the antenna side is connected in series with the low impedance line having the second predetermined length and with the high impedance line having the third predetermined length in turn, and since the feeding line side of this high impedance line is connected in series with the second low impedance line having the second predetermined length, the matching device for the microstrip antenna is small and simple in construction and can match the narrow-band antenna with the feeding line over a wide frequency band.

Having described the preferred embodiments of the invention with reference to the accompanying drawings, it is to be understood that the invention is not limited to those precise embodiments and that various changes and modifications thereof could be effected by one skilled in the art without departing from the spirit or scope of the invention as defined in the appended claims.

What is claimed is:

1. A matching device for an antenna in which said matching device is interposed between the antenna for receiving frequencies over a narrow frequency band and a feeding line so as to match said antenna and said feeding line over a wide band, comprising:

a standard impedance line of a first predetermined length and a first predetermined width provided at a side of the matching device connected to said antenna, said standard impedance being relative to a low impedance and a high impedance at the frequencies being received;

a first low impedance line of a second predetermined length and a second predetermined width connected to said standard impedance line, said second predetermined width being greater than said first predetermined width;

a high impedance line of a third predetermined length and a third predetermined width, said third predetermined length being greater than said first and second predetermined lengths and said third predetermined width being less than said first and second predetermined widths, said low impedance line of the second predetermined length and said high impedance line of the third predetermined length being connected in series with said standard impedance line; and a second low impedance line of said second predetermined length and said second predetermined width connected in series to said high impedance line at a side of the matching device connected to feeling line.

2. A matching device for an antenna according to claim 1, wherein said antenna is a microstrip antenna.

3. A matching device for an antenna according to claim 2, in which at a point where said high impedance line is connected to said first low impedance line and at a point where said high impedance line is connected to said second low impedance line said matching device is formed of an open-type microstrip line.

* * * * *